US005782735A

United States Patent [19]

Goodrich et al.

[11] Patent Number: 5,782,735

[45] Date of Patent: Jul. 21, 1998

[54] METHOD AND APPARATUS FOR PRODUCING INDIVIDUAL ROLLS OF PACKING MATERIAL

[75] Inventors: David P. Goodrich, Newtown, Conn.; Michael C. Hurwitz, South Salem, N.Y.; Roger E. Jester, Newtown; James P. Devine, Bethelehem, both of Conn.

[73] Assignee: Geopax, Ltd., Sandy Hook, Conn.

[21] Appl. No.: 304,384

[22] Filed: Sep. 12, 1994

[51] Int. Cl.[6] ..... B31D 3/02

[52] U.S. Cl. ..... 493/338; 493/966; 225/100; 83/18; 83/175

[58] Field of Search ..... 493/461, 462, 493/966, 338; 225/100; 83/18, 175

[56] References Cited

U.S. PATENT DOCUMENTS

| | | | |
|---|---|---|---|
| 2,203,084 | 6/1940 | Evans | 229/37 |
| 2,319,225 | 5/1943 | Grebe et al. | 154/46 |
| 2,345,844 | 4/1944 | Weiss | 117/98 |
| 2,382,400 | 8/1945 | Decker et al. | 229/87 |
| 3,040,968 | 6/1962 | Long | 229/87 |
| 3,065,785 | 11/1962 | Taber | 160/81 |
| 3,109,579 | 11/1963 | Crane | 229/87 |
| 3,306,513 | 2/1967 | Fishman | 229/15 |
| 3,454,455 | 7/1969 | Rasmussen | 161/112 |
| 3,466,733 | 9/1969 | Pajak | 493/462 |
| 3,550,842 | 12/1970 | Scholtz | 229/87 |
| 3,603,369 | 9/1971 | Scholtz | 150/52 R |
| 3,642,967 | 2/1972 | Doll | 264/51 |
| 3,655,501 | 4/1972 | Tesch | 161/109 |
| 3,758,312 | 9/1973 | Fairbanks | 161/109 |
| 3,762,629 | 10/1973 | Bruno | 229/87 F |
| 3,825,465 | 7/1974 | Stock | 161/112 |
| 4,105,724 | 8/1978 | Talbot | 261/112 |
| 4,265,456 | 5/1981 | Colijn | 428/134 |
| 4,688,708 | 8/1987 | Irvine | 225/100 |

FOREIGN PATENT DOCUMENTS

| | | | |
|---|---|---|---|
| 2033605 | 12/1971 | France . | |
| 225968 | 1/1909 | Germany . | |
| 2158539 | 5/1973 | Germany | B65D 5/04 |
| 53-103070 | 2/1977 | Japan . | |
| 793015 | 4/1958 | United Kingdom . | |

*Primary Examiner*—Jack W. Lavinder

[57] ABSTRACT

An expanded paper cylinder formed from a spiral is disclosed as a void fill. A delivery system is provided for manual and automatic delivery of the expanded paper from a continuous, unextended wound roll of an extendible sheet material. The cushioning material formed by the expander can be used as a expanded sheet around an article or as void fill, or can be formed into spiral cylinders for use as void fill. The manual dispensing system includes a support member supporting a rotatable feed roll. A restraining restraining device slows the free delivery of the wound feed roll of unextended sheet material, so that the sheet material expands while it is being drawn, under tension from the feed roll. An automatic system uses expander rollers to expand the slit paper and can be coordinated with apparatus which cuts and forms the spiral cylinders.

13 Claims, 17 Drawing Sheets

Completely flat □

METHOD AND APPARATUS FOR PRODUCING INDIVIDUAL ROLLS OF PACKING MATERIAL

BACKGROUND OF THE INVENTION

The invention relates to a mechanism for expanding a slit sheet material as disclosed and claimed in co-pending patent applications 08/157,277 filed Nov. 26, 1993, and 08/255,062 filed Jun. 7, 1994, which is a continuation-in-part of 08/119,472 filed Sep. 10, 1993, which is a continuation-in-part of 07/962,944 filed Oct. 19, 1992, which application is a continuation-in-part of copending application, 07/936,608, filed Aug. 27, 1992, now abandoned, which application was a continuation-in-part of then copending application 07/851,911, filed Mar. 16, 1992, now abandoned, the subject matter of which is incorporated herein, as though recited in full.

FIELD OF THE INVENTION

The present invention relates in general to the methods and apparatus to manually or automatically expand a slit paper type of packaging material and to apparatus for forming the expanded slit paper into spiral cylinders of cushioning materials to be used in packaging.

BRIEF DESCRIPTION OF THE PRIOR ART

Copending U.S. patent application Ser. No. 08/119,472, Method and Apparatus for Producing Individual Rolls of Packaging Material, discloses a mechanism for automatically expanding slit sheet of paper to form an expanded material for use in packaging, as a wrap or a void fill material. The automated system rapidly produces large quantities of expanded material. In numerous applications, however, relatively small quantities of packaging material are required and the investment in automated equipment is not warranted by the volumes involved in the operation.

The use of a clamp to fix one end of a stack of cut sheets of unexpanded material provides a low cost alternative to the automated system. However, it is less costly to produce the slit material in roll form and the rolls of unexpanded slit material provide storage and use advantages over the rectangular sheets. Among other things, the use of a continuous roll of unexpanded sheet material permits the user to withdraw a material of varying lengths.

Accordingly, an expander which can work with roll stock material is desired. In order to advance the roll stock material between the jaws, the choice would appear to be between a manual system in which the user grabs the cut end of the sheet while the jaws of the clamp are spread and a mechanism to advance the roll stock material between the jaws of the clamp. As employed herein, the term jaws describes the surface of the clamps which contacts the paper. It is essential to provide a system which is safe to use and therefore, a clamp should not open wide enough for a person to place a hand between the jaws of the clamp. The mechanism alternative, on the other hand, provides an undesirable cost disadvantage.

BRIEF DESCRIPTION OF THE DRAWINGS

The objects and advantages of the instant invention will be apparent when the specification is read in conjunction with the drawings, wherein.

DETAILED DESCRIPTION IF THE INVENTION

Figure 1:
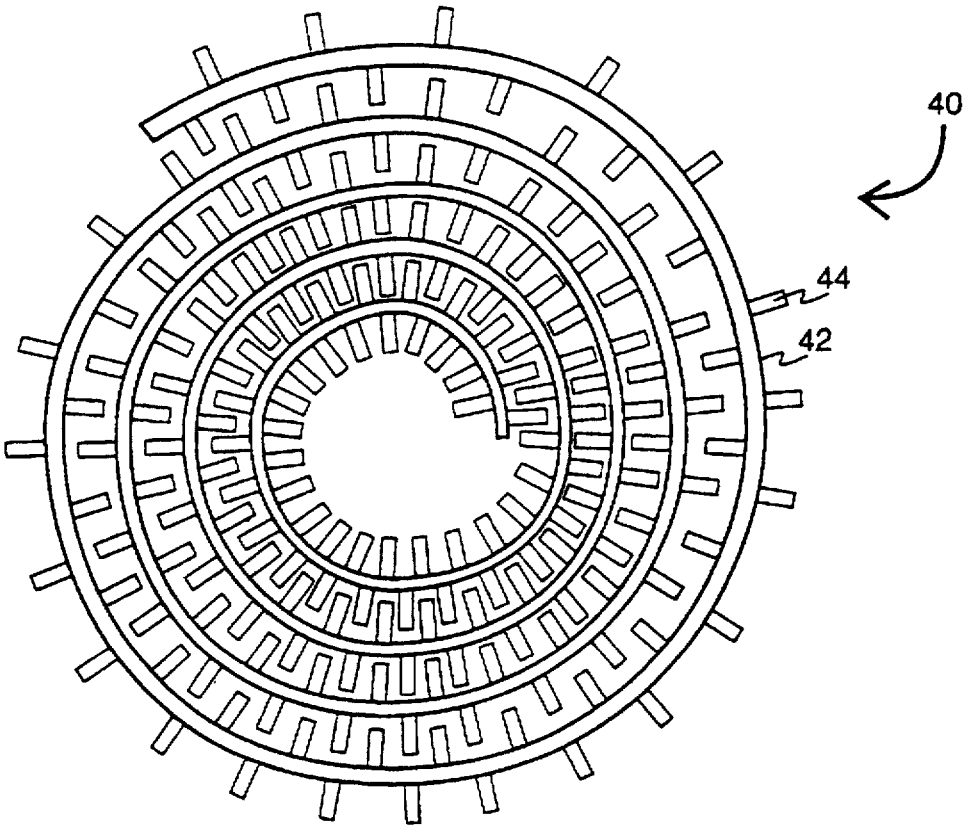
FIG. 1 is an end view of a representation of the spiral cylinder of the instant invention.

The instant disclosure relates to the method and equipment for the expansion of an expandable material, preferably slit, recycled paper, as a packing material and to the use of the expanded material as a void fill in packaging.

The paper, once expanded creates semi-rigid peaks or lands. These peaks are similar to a spring in that once force is applied and removed, they return to their original positioning, providing the elastic limit is not exceeded. The elastic force created by the resistance of the paper fibers slows the acceleration of the force. The work performed by movement of the semi-rigid peaks as a force is applied by an article,.is the elastic potential energy of the expanded material. The yield point is the point beyond stress when a large increase in strain occurs with almost no increase in stress.

The use of expanded paper in widths of ½ inch increments from ½ inch to 6 inches and unrolled, unexpanded paper lengths varying from 3 to 24 inches was tested as a void fill. The material was found to retract to some degree if not bound at the ends or wrapped around an article, making optimum expansion difficult to achieve. The slit pattern can be varied with optimum results being obtained with patterns which form hexagonal cells. With the identical paper, load bearing capacity is dramatically increased with the hexagonal pattern, as compared with a diamond cell yielding slit pattern. By winding the paper in the form of a cylinder, the tension on the expanded paper can be maintained without the use of adhesives or the like, since the cells "interlock", thus preventing unwinding of the completed cylinders. The sheet material decreases in width during the expansion step and the dimensions of the cylinder are in terms of final dimension of the finished cylinder. Cylinders less than 1 inch in length having a tendency to unravel, due to insufficient interlocking of cells, with the problem increasing with decreasing length. Cylinders under 1 inch in diameter offer insufficient cushioning effect for general applications. In terms of the correlation between unexpanded flat sheet material and finished cylinders, one square foot of sheet material will produce about two and three quarter finished cylinders, as one 2×2 cylinder equals 0.376 square feet of sheet material. Obviously, the tighter the cylinder is wound, the greater the amount of sheet material required to form a cylinder. Thus, the aforenoted correlation between sheet material square feet and cylinder diameter and length, is a measure of how tightly the cylinder is wound. Although the tighter the cylinder, the firmer the cushion effect which is achieved, winding the cylinder too tightly will have the effect of removing air from the cylinders and lessening their cushioning qualities. Hence, winding forces on the slit paper material and the quantity of slit paper material used to produce a cylinder are critical. Thus, the cylinders can be customized to meet specific system requirements.

Expanded paper cylinders were attached to hand-made cardboard cores and wound around the cores. Cylinders ranging in size from about 1×1 inch to 6×6 inches were tested. All sizes worked, with the 2×2 size being most effective. The solid core presented a rigid surface and lacked cushioning for side impact.

Coreless cylinders were formed using hand powered winders. The coreless cylinders were better at absorbing impact at the sides and edges of the cylinders, than the rigid core centered cylinders. However, the number of square feet of sheet material required to produce a cubic foot of coreless cylinders was higher than optimally desired, from a cost standpoint. On the other hand, the coreless cylinders provided highly effective cushioning characteristics.

Using a small hand winder, cylinders were produced with a hollow core and characterized by a 40 square feet of unexpanded sheet material to 1 cubic foot of cylinder. The hollow core cylinders provided excellent impact and vibration protection. The hollow center spiral wound expanded paper provided a greater degree of soft cushioning than was provided by the tightly wound coreless cylinders of expanded paper. The cylinder of expanded paper with a hollow core center provided an excellent compromise between excessive use of raw material in the tightly wound cores and lack of side impact protection and added expense associated with the production of expanded paper cylinders with a rigid core.

To form the cylinder of the instant disclosure the slit paper is expanded and rolled into a cylindrical spiral, having a predetermined diameter and length based on end use. As disclosed, as the paper is expanded, it forms raised cells which, when rolled, interlock with cells in adjacent layers as the paper spirals outward. The interlocking of the cells eliminates the need to secure the cylinders, thereby making them immediately ready for use. The spiral cylinder 40 of FIG. 1 is a conceptual illustration of an end view, showing the concept of the interlocking cells raised from the land, however for clarity, rectangles are used to depict the cells formed by the row spacing 44 and the slit spacing 42.

Figure 2:
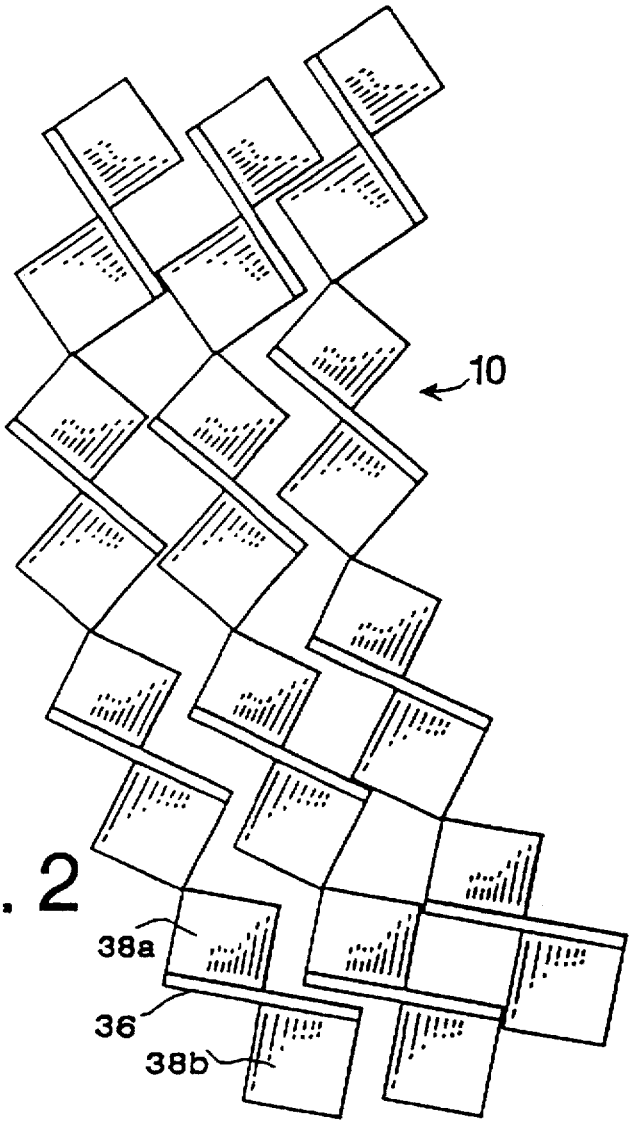
FIG. 2 is a partial end view of the expanded paper forming the spiral cylinder.

In FIG. 2, a portion of the spiral cylinder 10 is illustrated which more accurately depicts the formation of the cells. The actual cells cannot be seen in the side view of FIG. 2, however the material forming the cells is depicted. The row spacing 38*a* and 38*b* and the slit spacing 36 are warped, thereby forming the peaks and valleys which interlock with one another.

The self-locked cylinder provides maximum protection of an article by absorbing the energy created by the impact. The absorbency is achieved by placing the layers in a position to force interaction between the cells. The positioning of the paper in a spiral prevents the paper from turning back on itself or twisting, which lessens the cushioning effect from the cell interaction. The spiral configuration is not only the most economical and easy to produce, it is structurally the most effective. The force applied to the cylindrical elastic body compresses in toward the center, with each interior layer creating an elastic force to return to its original position. The interaction of the cells additionally distributes the impact force through the entire cylinder, thereby providing increased protection of edge or corners of the object being shipped. This is unlike the commonly used styrofoam peanuts which act independently. With the styrofoam peanuts, if the corner of an item receives the main force of impact, the peanuts separate, thereby allowing the item to slide within the box. The interlocking of the cells of the cylinders not only interlocks each individual cylinder but locks the cylinders to one another, preventing slippage of the item within the box.

The spiral cylinder 10 can be varied in size dependent upon the intended use. The preferable size is approximately 2 inches in length and 1½–2 inches in diameter. The hollow core cylinders provide good packaging protection from all angles of impact and utilize the square footage within the core most efficiently. Desired results are obtained with paper weight of 70 pound per 3000 square feet of recycled Kraft, 100% post consumer recycled paper and 3.2 inches by 16 inches (52 square inches of unexpanded slit paper) produces one hollow core cylinder. One hundred twenty cylinders, representing 40 square feet of unexpanded paper, filled one cubic foot volume as opposed to 210 tightly wound coreless cylinders being required to fill the same volume. Cylinders with a rigid cardboard core required 110 cylinders to fill one cubic foot. One cubic foot of unexpanded 70 lb. slit paper produces 37.2 cubic feet for void filling purposes when utilizing the hollow core method.

Figure 3:
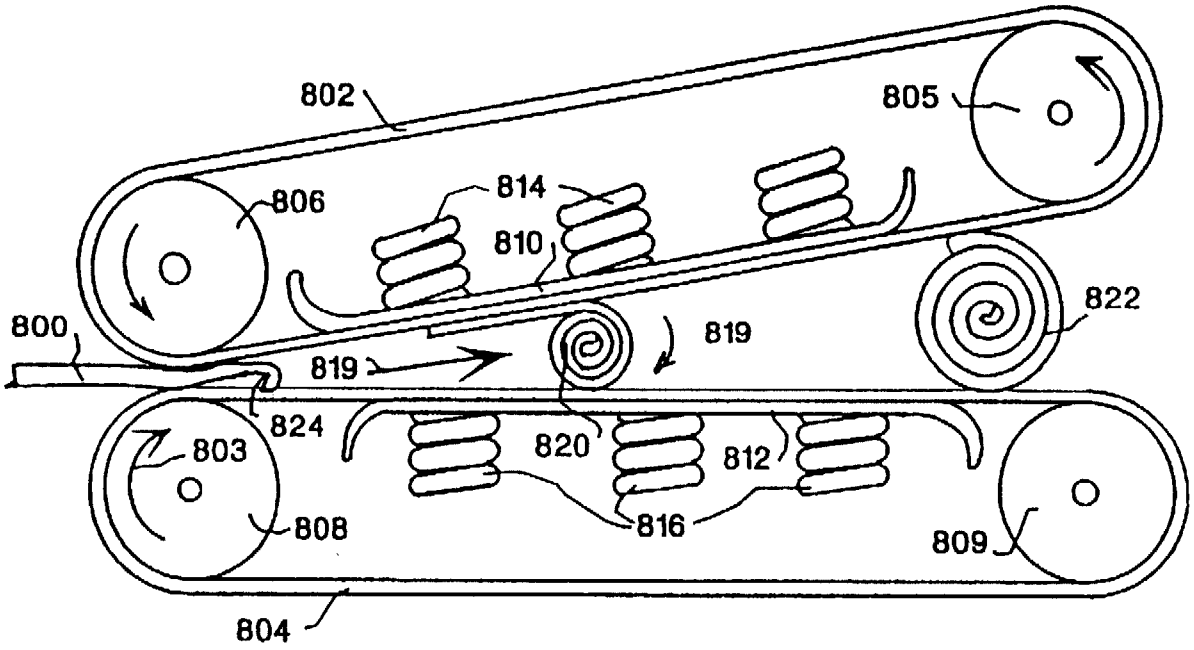
FIG. 3 is a side elevation of an alternate apparatus for spiraling expanded sheet material into cylinders for use as void fill material.

FIG. 3 is a side elevation of an apparatus for spiraling expanded sheet material into cylinders for use as void fill material. In the embodiment of FIG. 3, expanded sheet material 800 is fed between the upper moving belt 802 and the lower moving belt 804. The upper moving belt 802 is driven and carried by the upper belt drive roll 806 in the counter clockwise direction, as indicated by directional arrow 801. The lower belt drive roll 808 carries and powers the lower moving belt 804 in the clock wise direction, as indicated by directional arrow 803. The upper belt 803 is tensioned between the drive roll 806 and the cooperative roll 805. The tension plate 810 is biased against the belt 802 by the tension springs 814. Similarly, the lower belt 804 is tensioned between the drive roll 808 and the cooperative roll 809. The tension plate 812 is biased against the belt 804 by the tension springs 816.

The lower belt 804 rotates opposite the upper belt, thereby driving the forming cylinder 820 in the direction indicated by directional arrows 819. The upper belt 802 is rotated at seven times the speed of the lower belt 804, thereby causing the leading edge 824 of the expanded sheet 800 to drag and curl under. As the sheet progresses in the direction of arrow 819, the curling effect is continued forming partly formed cylinder 820. The curling or spiraling effect continues until a fully formed cylinder 822 is produced and delivered to a receiving region, not shown.

Figure 4:
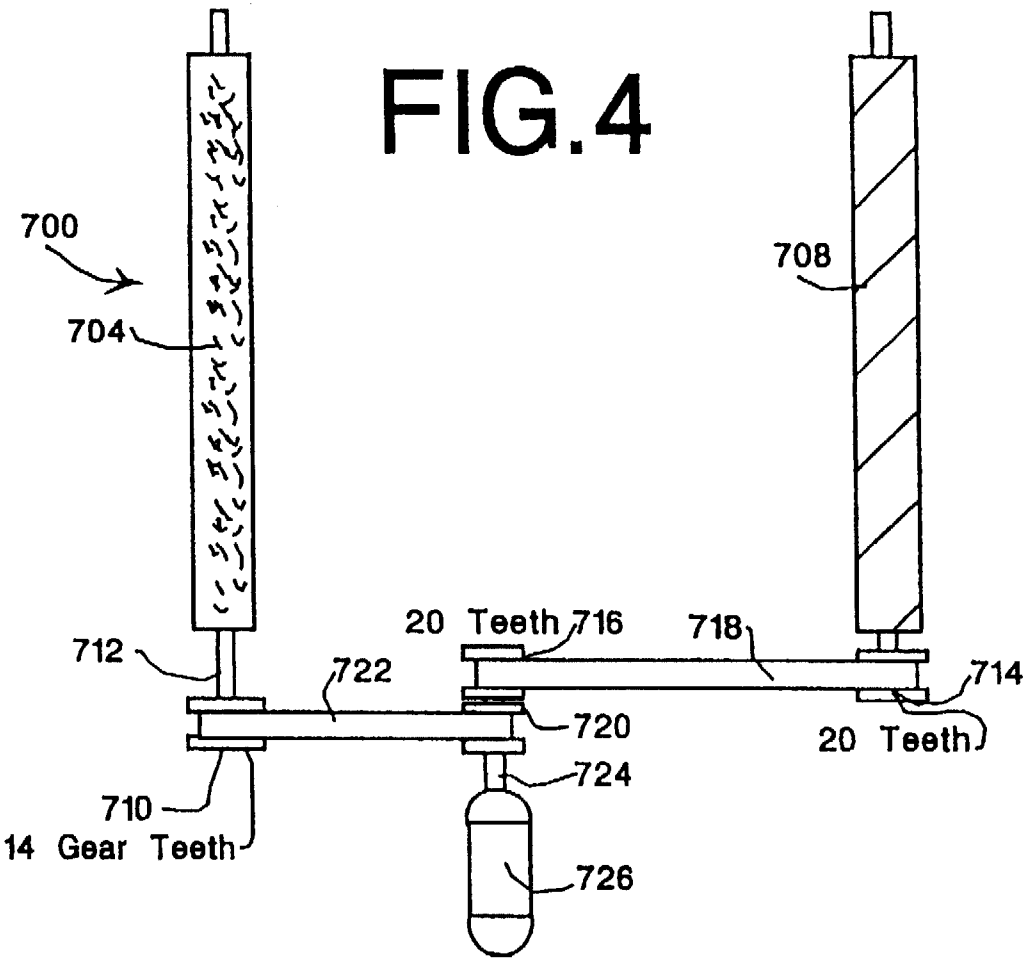
FIG. 4 is a top view to the expansion machine of the instant invention.
Figure 5:
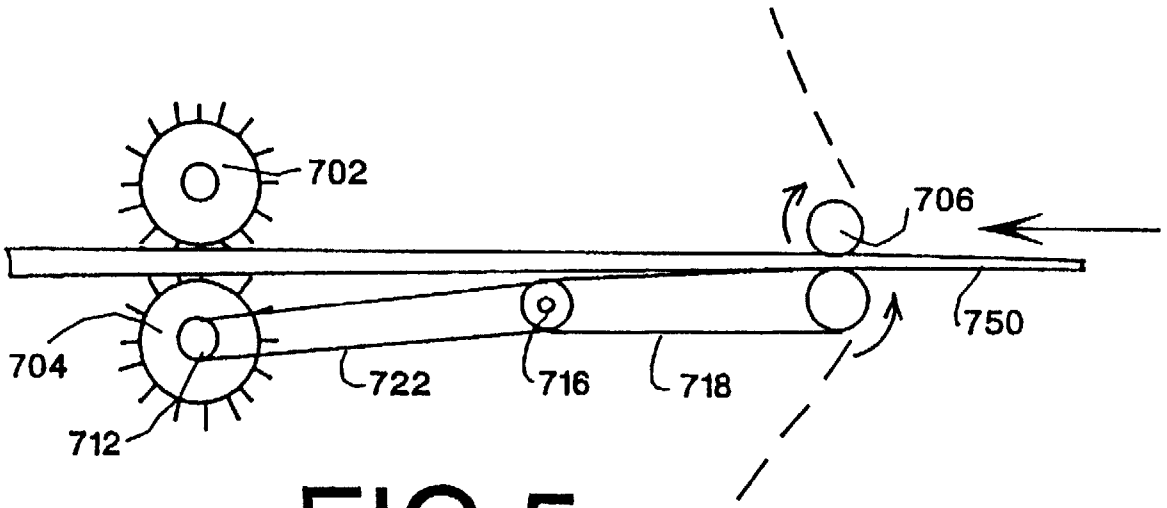
FIG. 5 is a side view of the expansion machine of FIG. 4.

FIGS. 4 and 5 illustrate the expansion machine 700 which rapidly produces optimum expansion of the slit paper 750. The paper is fed from a storage roll, not shown, to the upper and lower drive rollers 706 and 708, where it is placed between the rollers 706 and 708. The paper storage roll can be placed at any point along a 100° arch from the drive rollers 706 and 708, using the point directly perpendicular from the drive rollers 706 and 708 as the 0° point. Both the upper drive roller 706 and the lower drive roller 708 are covered with a friction material, such as shrink tubular material made of a heat shrinkable polymer, as for example polyvinyl chloride. Alternatively, a rubber spray or painted coating can be used. Additionally vinyl tape covered rollers and rubber rollers can be used. Abrasive coatings tended to produce some scratching of the paper and formation of dust due to the action of the abrasive material on the paper.

There is no theoretical upper limit to the amount of friction caused by the roller fiction covering, except that damage to the paper must be avoided. Therefore, the use of a coarse material is to be avoided.

The tension between the drive rollers and the expansion rollers must be sufficient to open, or expand the slit paper, but not sufficient to tear the paper. Typically, with a 30 pound paper, 2.5 oz. of force per linear inch, can be applied and with 70 pound paper, 5 oz. of force can be applied. The expansion should be sufficient to not only expand the paper, but also to crack some of the fibers, thereby decreasing the tendency of the paper to return to its unexpanded form. With the aforenoted 70 pound paper, it required a 0.011 hp motor to deliver paper at a rate of 300 inches per minute, expanded one linear inch.

Utilizing a 20 by 36 inch sheet of the aforenoted unexpanded 70 pound paper, with one end secured in a rigid fixture across its entire width, the paper was suspended vertically and a force was applied to expand the paper. A force of about 50 ounces, that is, 2.5 oz. per inch, initiated the expansion of the paper and 3 oz. per linear inch opened all of the paper cells. 5 oz. per linear inch opened all cells fully and yielded cell wall fiber tearing which aids cell walls to remain open after the expanded paper is released in the open position. A force of 7.5 oz. expanded the paper and tore it after 10 seconds of continued stress. 10 oz. per linear inch opened the cells and immediately tore the paper. The use of about 5 oz. was thus shown to provide the optimum results.

The lower drive roller 708 is driven by the motor 726 through the rotation of the motor gear 716 and drive gear 714. The rotation created by the motor 726 is transmitted along motor shaft 724 to the motor gear 716 where it drives the drive belt 718, which in turn rotates the drive gear 714. The motor gear 720, also connected to the motor shaft 724, drives the expansion belt 722, which in turn rotates the expansion gear 710. Due to the spacing of the motor gear 716 and the motor gear 720 along the motor shaft 724, an expansion shaft 712 is generally provided between the expansion gear 710 and the upper expansion roller 702 and lower expansion roller 704. The drive gear 714 is provided with 20 teeth as compared to the expansion gear 710 which has 14 teeth. The difference in the number of teeth changes the rotation speed of the upper expansion roller 702 and lower expansion roller 704 as compared to the upper drive roller 706 and lower drive roller 708, allowing the motor shaft 724 to rotate at a single speed. The differential can be obtained by a number of methods known in the prior art and the foregoing is not intended to limit the scope of the invention. The speed differential between the upper and lower expansion rollers 702 and 704 and the upper and lower drive rollers 706 and 708 is critical as it provides the expansion of the slit paper 750. The slit paper 750 is being removed from the expansion machine 700 faster than it is entering, thereby forcing the slit paper 750 to expand. The speed differential between the expansion rollers 702 and 704 and the drive rollers 706 and 708 must be calculated to provide the required amount of expansion based on the weight of paper and end use. In the gear assembly as illustrated in FIGS. 4 and 5, the expansion gear 710 and drive gear 714 can be changed to provide a increase or decrease in the speed differential. Other methods of changing the speed differential can be obtained and are known in the prior art.

The spacing of the expansion rollers a distance of about 6 inches from the drive rollers produced some binding in the middle of the paper, apparently due to the contraction of the paper which coincides with the expansion of the paper in thickness and length. A space between the expansion and drive rollers of about 11.25 inches worked well for 19.5 inch rolled paper. With 3 inch wide paper, a minimum of 4 inches of separation between the roller sets. The distance between the drive rollers and the expansion rollers varies proportionally with the width of the unexpanded paper.

The expansion device can be used to produce expanded product for use directly as a wrapping material. The automated roll dispenser provides for immediate use of the expanded paper minimizing space requirements while yielding maximum packaging usage by allowing the user to pull tightly during the wrapping process by stopping or braking when needed. At the end of wrapping, prior to tearing, the foot pedal is released and the automated expander brakes for final pulling and tearing. This leaves the process of maximum stretch intact for greatest packaging protection. An electronic unit can be employed to deliver measured quantities of expanded paper. Breaking at the end of the delivery provides for the user to tear the desired length of paper from the roll of paper. Alternatively, a cutting blade can be used to severe the delivered quantity of paper from the remainder of the roll.

The upper expansion roller 702 and the lower expansion roller 704 are covered with a material which provides the affect of fingers. The covering must grip the unopened slit paper 750, without ripping the paper, and pull it open through use of the differential speed between the expansion rollers 702 and 704 and the driver rollers 706 and 708. The use of soft rubber covered rollers works to produce even expansion over the width of the paper. However, deformation of the paper can be experienced, in the form of crushed cells. That is, at the point of contact with the pair of expansion rollers, the expanded cells can be crushed by the rollers. The use of open cell and light foam can work to provide the required expansion. However, low density, open cell foam have a life span which is shorter than optimally desired. When soft bristled brushes of the type employed in photocopy machine, were used, some difficulty was experienced in starting the expansion process. Harder bristled brushes cause some trouble in releasing the paper. Optimum results were obtained with medium stiff bristles cut to approximately ⅛ inch in length. Bristles can be made of metal wire, such as carbon steel, stainless steel, brass, bronze and a variety of bristle dimensions are commercially available.

The preferred material is a nylon hook fiber of the type found in hook and loop fasteners of the type sold under the trademark VELCRO. The use of a set of rollers faced with hook ended fibers provided the required expansion without distortion of the expanded paper or deterioration of the rollers. Unlike, relatively firm foam covered rollers, the hook fibers did not crush the expanded cells as they passed between the expansion rollers. It should be understood that the role of the expansion rollers is critical in that they must be able to grip and pull the paper so as to impart a speed of travel to the paper which is greater than the speed of the paper when it passes through the drive rollers. This requirement is in conflict with the need to permit the expanded paper to pass between the rollers without the expanded cells being crushed.

Figure 6:
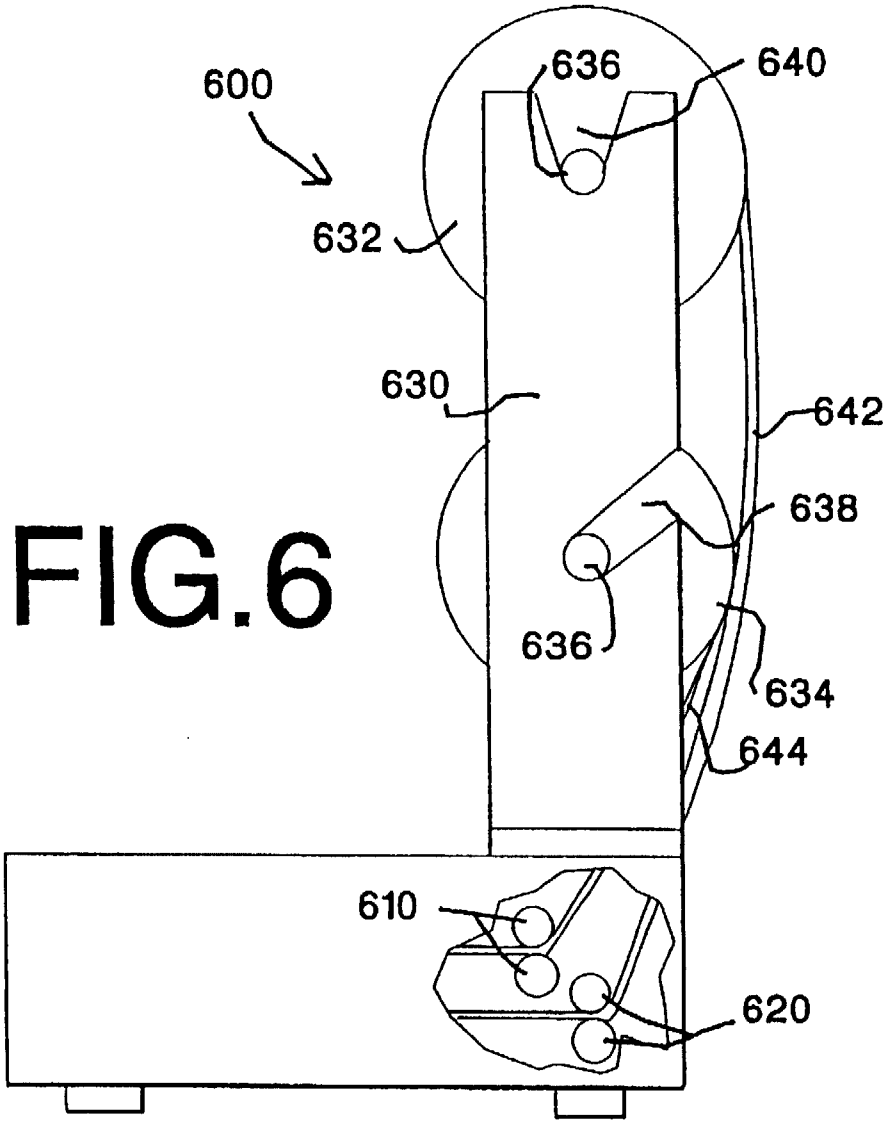
FIG. 6 is a side view of the dual paper positioning in conjunction with the expansion machine of FIG. 4.

An alternate embodiment to the expansion device of FIGS. 4 and 5 is illustrated in FIG. 6. The multi roll expander 600 operates on the same basis as the expansion device 700. The expander 600 is provided with a paper support unit 630 which is provided with at least one retaining area 638 to receive the paper roll 634. The retaining area 638, as illustrated herein, is a notched portion which receives a bar 636 which is placed through the core of the paper roll 634. The expander 600, as illustrated, holds two rolls of paper 632 and 634 in retaining areas 638 and 640, however additional rolls can be added. The paper 642 from roll 632 is fed into the bottom roller set 620 and the paper 644 from roll 634 is fed into the top roller set 610. The top roller set 610 and bottom roller set 620 are each designed as described in FIGS. 4 and 5.

Figure 7:
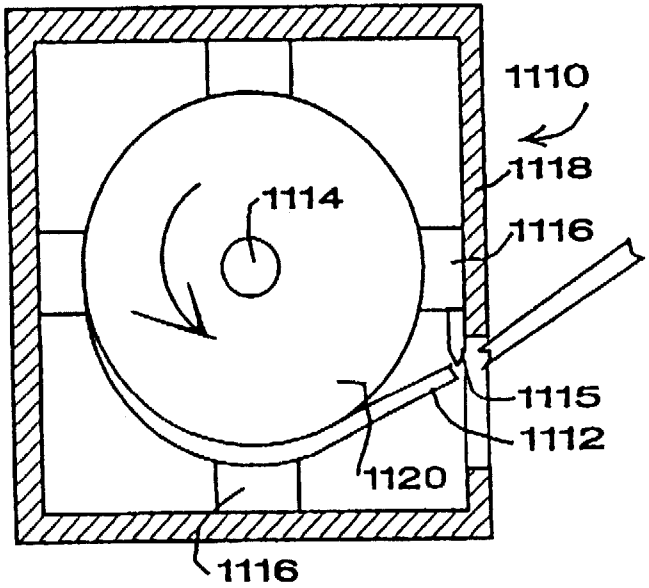
FIG. 7 is a schematic side view of a feed roll housed within a container.

One embodiment of a manual expander system 1110 is shown in FIG. 7, wherein the roll 1120 is retained within a container 1118. The sheet material 1112 is expanded by drawing the sheet material 1112 directly from the supply roll 1120 at a rate which is greater than the rotational speed of the supply roll 1120. The control of the rate of supply of sheet material 1112 from the supply roll 1120 can be achieved by limiting the rotational speed of the supply roll 1120 directly, as for example, through the use of a friction bearing on the axle 1114. This is not, however, the optimum method, as the friction bearing, or other method used to provide tension, must be frequently altered to coincide with decrease in the supply roll 1120 sizing or addition of a new supply roll 1120.

Figure 13:
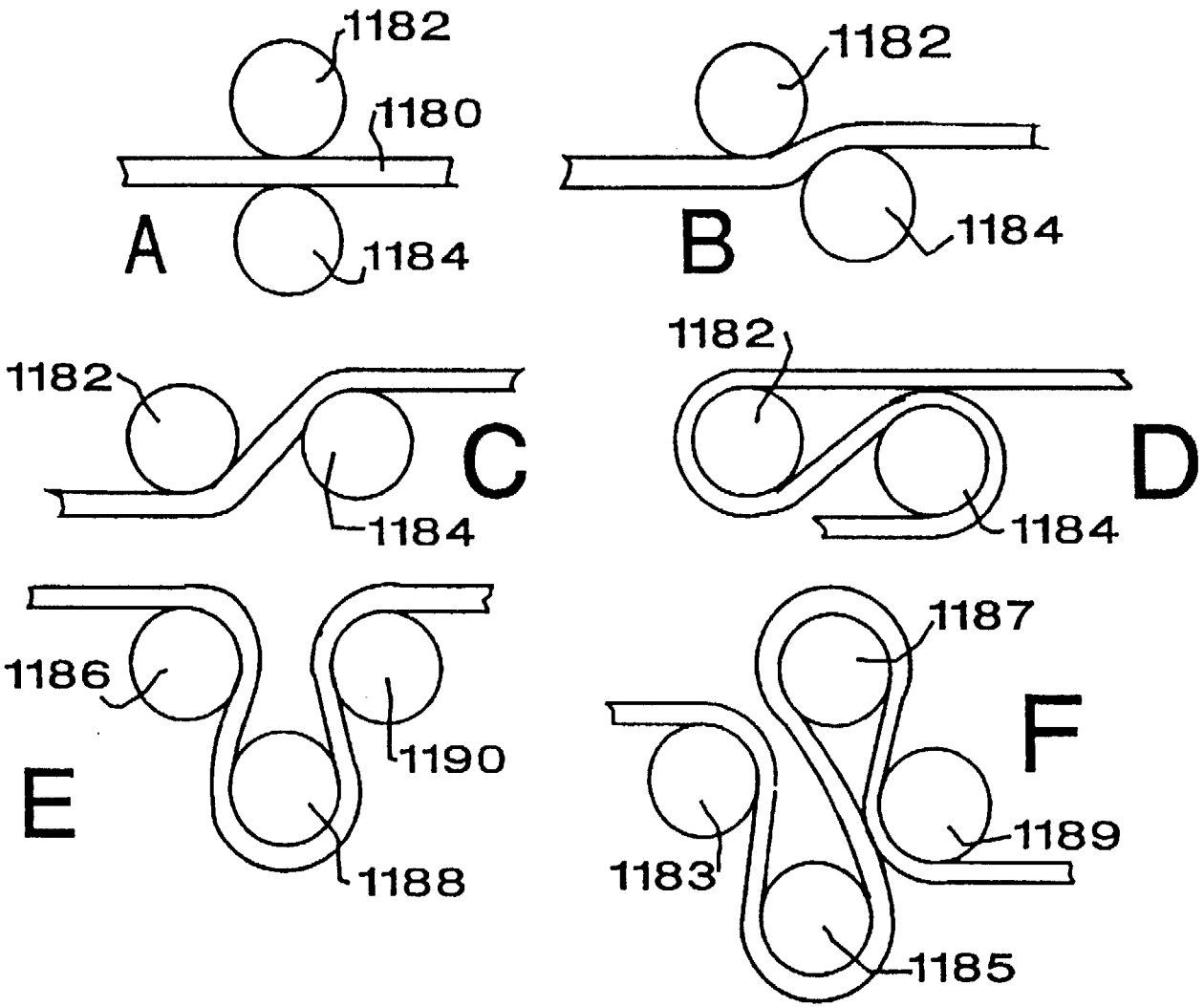
FIG. 13 A–F are schematic illustrations of an alternate embodiments of a two roll delivery system.

The supply roll 1120 and the associated elements can conveniently be supported by a frame 1116, which can be in the form of a pair of X members. The ends of the legs of the frame 1116 can be in contact with the side walls, or positioned in the corners, of the container 1118. The container 1118 is provided with a cut line 1115. The cut line 1115 is preferably provided with a serrated, metal portion to easily tear the paper at the desired length. The container 1118 can be a corrugated cardboard box or lightweight wood. Each of the embodiments of FIGS. 9 and 13 can be employed within the container 1118.

Figure 10:
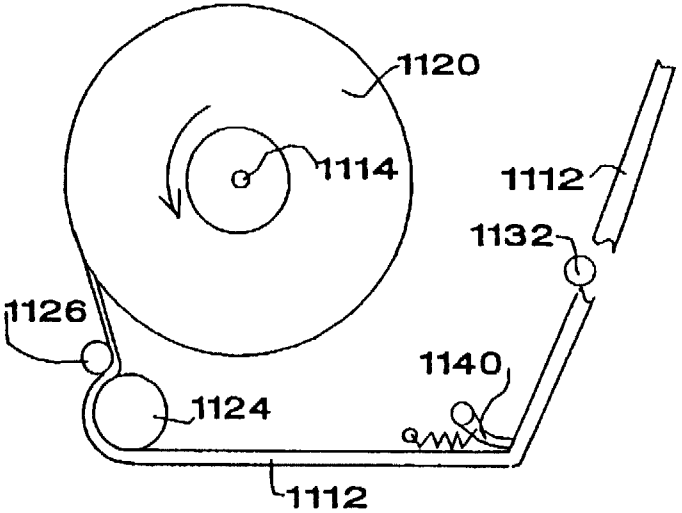
FIG. 10 is a side view of a further embodiment of a delivery system.
Figure 9:
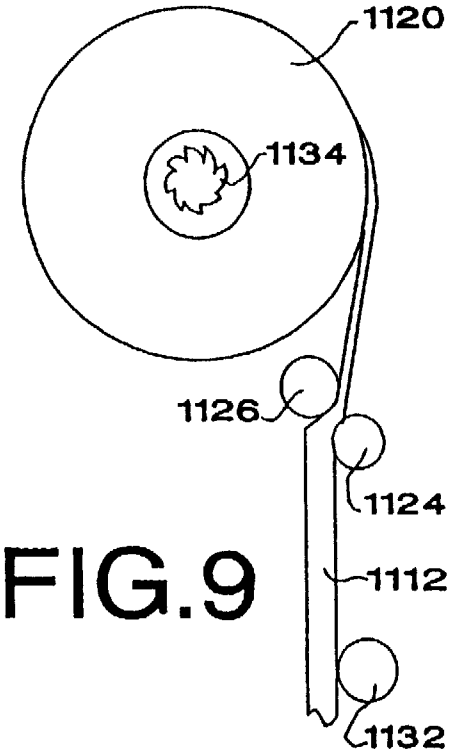
FIG. 9 is a side view of another embodiment of a delivery system, showing a feed roll, restraining rolls, and a tear bar.
Figure 11:
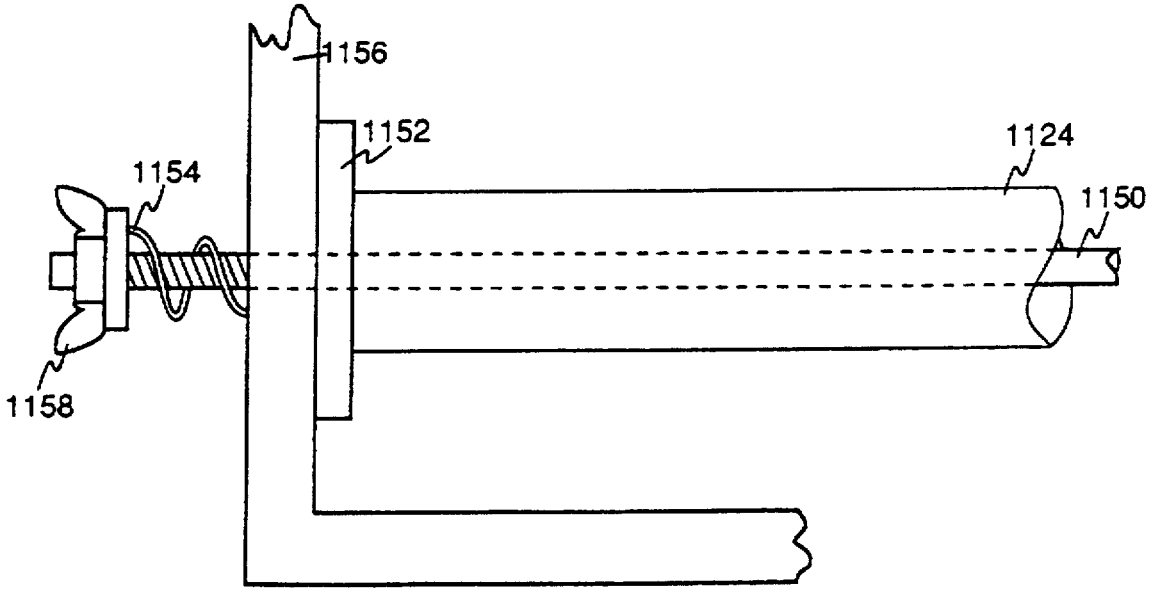
FIG. 11 is a fragmentary illustration of tensioning mechanism for a restraining roll.

Preferably, the manual expander system 1110 is provided with rollers to expand the sheet material 1112. In the embodiment of FIG. 9, expansion is achieved by passing the sheet material between a guide roller 1124 and a secondary roller 1126. A pawl (not shown) engages the teeth of the wheel 1134, preventing counter-clockwise rotation. Any other convenient rotation direction limiting mechanism can be used. The guide roller 1124 is prevented from freely turning by means of a friction bearing, such as illustrated in FIG. 11. The sheet material 1112 is held firmly against the guide roller 1124 by the secondary roller 1126, as shown in FIG. 10. By holding the sheet material 1112 against the guide roller 1124, the secondary roller 1126 controls, or restricts, the speed of movement of the sheet material 1112 through the drag of the guide roller 1124. Where the speed of rotation of the supply roll 1120 is controlled, such as in FIG. 7, the guide roller 1124 can be free rolling.

Figure 8:
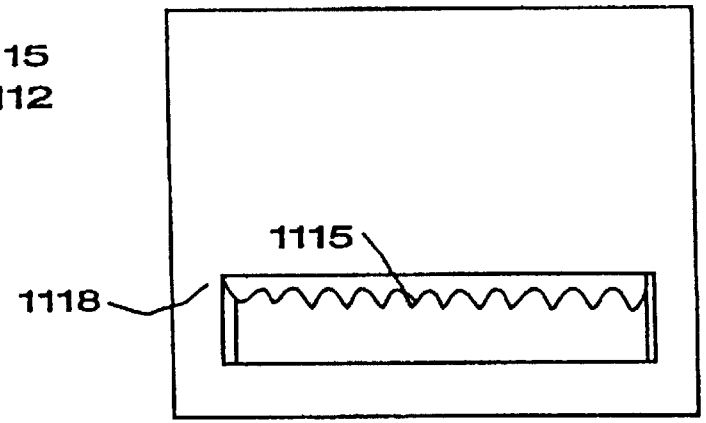
FIG. 8 is front elevational view of the container of FIG. 7.

As the sheet material 1112 is pulled manually from the supply roll 1120 it is expanded as it passes between the guide roller 1124 and secondary roller 1126. When the desired length of material has been withdrawn it is torn from the remainder of the sheet material 1112. The tearing action is greatly facilitated by drawing the expanded sheet against a tear bar 1132. The tear bar 1132 can be a threaded rod or other rough surfaced member, such as the jagged member 1115, illustrated in FIG. 8. The expanded sheet material has an irregular surface which engages the surface of the tear bar 1132, and provides for the controlled tearing of the sheet material.

The manual expander system 1110 can be mounted on a table or floor, or suspended from an overhead support, for downward dispensing of expanded paper, as illustrated in FIG. 9. The supply roll 1120, or rolls, can be offset from the final direction travel of the paper within a 300° arc, with the axle 1114 of the supply roll 1120 parallel to the axis of the guide roller 1124 and secondary roller 1126. The sheet material 1112 can be provided by multiple rolls, or a multi-ply roll, with the limitation being the strength of the operator to draw paper against the required tension resistance.

In the embodiment of FIG. 10, the manual expander system is configured as for a floor or table set up. The sheet material 1112 leaves the supply roll 1120 and is fed between the secondary roller 1126 and the guide roller 1124. The sheet material 1112 passes along to the retaining bar 1140 where it is dispensed, expanded, until a sufficient length is achieved. The spring loaded retaining bar 1140 prevents the paper 1112 from pulling toward the guide and secondary rollers 1124 and 1126 due any clockwise motion of the supply roll 1120.

Preferably, the guide roller 1124 is friction tensioned by means of the mechanism of FIG. 11. A friction plate 1152 is mounted adjacent the guide roller 1124 and attached to the wall 1156. The guide roller 1124 is mounted on a shaft 1150 which is passed through the friction plate 1152 and the wall 1156 of the carrier for the manual expander system 1110. At least the end of the shaft 1150 is threaded to receive a wing nut 1158. The shaft 1150 passes through the wall 1156 and receives a spring 1154, which is secured onto the shaft 1150 with the wing nut 1158. The spring 1154 must have a diameter less than that of the wing nut 1158 to maintain the spring 1154 in place. The wing nut 1158, when tightened, applies a selected amount of pressure to the spring 1154, thereby pulling the roller 1124 against the friction pad 1152. The pressure can be easily regulated to maintain the desire amount of turning resistance. The force applied to the paper must be within a relatively controlled range. The use of too much force will tear the paper rather than produce controlled expansion, and too little pressure will unwind the paper without expansion. The preferable expansion force is in the range from about 3 oz. to about 7.5 oz. and preferably about 5 oz. per linear inch of paper width.

Tensioning can also be provided by pressing together a pair of rollers through which the paper travel, thereby tying the rate of movement of the paper to the rotational speed of the guide rolls, and restricting the rotational rate of the rolls. Tensioning can also be regulated by varying the positions of a pair of guide rolls relative to the travel of the paper. As the position of at least one guide roll is moved such that the paper contacts an increasing degree of the perimeter of the guide rolls, the tension is increased. The paper acts to force apart the two guide rolls 1124, and 1126 of FIG. 9. In the embodiment of FIG. 10, the guide rolls displace the direction of travel of the paper to a greater extent than in the position illustrated in FIG. 9, thereby providing an higher degree of tension on the paper. Additionally, surface tension can be applied by a band with a weight or spring. The friction device can be a friction clutch, pneumatic, magnetic or hydraulic tension mechanism. The magnetic tensioning mechanism is sold as a magnetic particle tensioning brake. The exact form of the tensioning mechanism is not critical, and any commercially available mechanism can be used.

The portion of expanded paper between the supply roll 1120 and the cut end tends to retract once it has been released from the tension of being pulled. The retraction of the leading edge of the paper can be restricted by a roller (not shown), or the aforenoted spring loaded retaining bar 1140, of FIG. 10. The springs enable the paper to force the gripping fingers aside during expansion but pull the gripping fingers into tighter engagement with the paper if the paper is pulled in the reverse direction. The retraction prevention mechanism has its paper contacting surface covered with a surface for gripping the expanded paper. The covering must grip the unopened slit paper when moving in the retract direction, without ripping the paper, when the user is pulling it off of the feed roller. The material used to grip the paper can be angled to provide the unidirectional travel of the paper, as compared to being on a spring loaded mechanism which can give way during the paper expansion step. The gripping mechanism can be a plurality of monofilament polymer strands mounted in an inclined position relative to the travel line of the paper. The incline permits the paper to slid past the gripping mechanism in one direction, but results in the engagement of the strands and the cells during travel in the reverse direction.

The sheet material 1112 must not be deformed, through the crushing of cells, while the expanded paper is passing through the retraction prevention mechanism. At the point of contact with the pair of retraction prevention rollers, either the spring loaded bar or the single retraction prevention roller, the expanded cells can be crushed by the retraction mechanism. The use of open cell and light foam can work to provide the required expansion.

Figure 14:
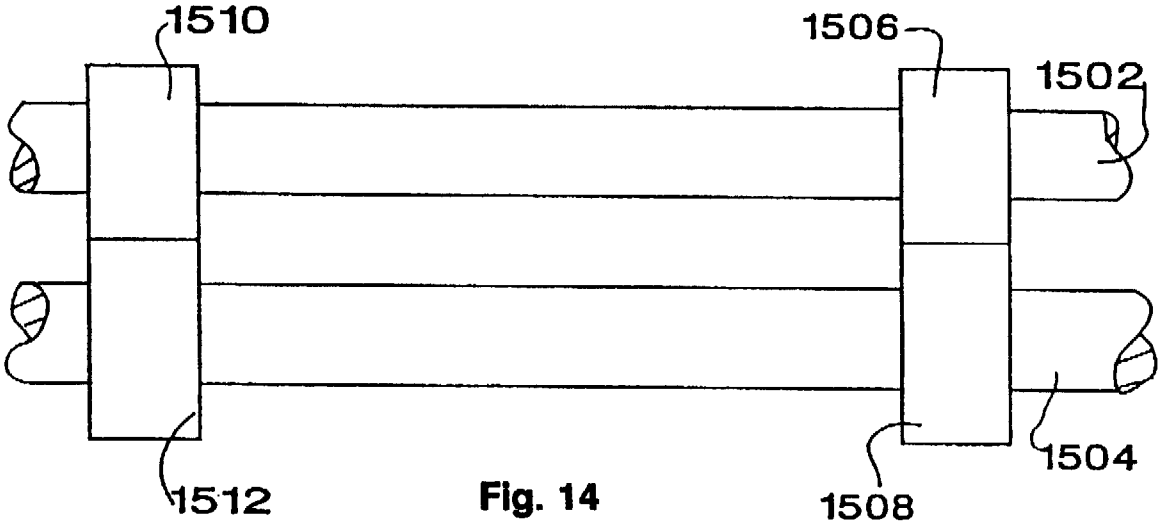
FIG. 14 is a fragmented illustration of a two roll delivery system using guide wheels.

As noted heretofore, the preferred material is a nylon hook fiber which does not crush the expanded cells as they passed under the retraction mechanism 1140. The barb of the hook is oriented in the leading position such that the barbs engage the slits in sheet material during the retraction of said paper, but permit the sheet material to slid past during the unwind/expansion step. In the modification of FIG. 14, the bar 1140 is spring biased toward the sheet such that unwinding movement causes the bar to move away from the paper. Conversely, a tendency of the paper to rewind or retract, pulls the bar toward the paper. Thus, the hooks dig into the slits during rewinding, but freely permit the paper to move in the unwind direction.

In another embodiment a mechanism in which the retraction prevention is provided would include a guide roll and bracing roll positioned on either side of the paper. The guide roll is provided with the same type of hook filaments, bristles, or the like, as provided for bar 1140 to prevent crushing the paper. Reverse travel is prevented through the use of any convenient means for limiting the guide roll to a single direction rotation. Conveniently, a ratchet mechanism such as wheel 1134, illustrated in FIG. 9 can be used. The bracing roll maintains the paper against the guide roll and can be either free rolling or provided with reverse travel means.

Figure 12:
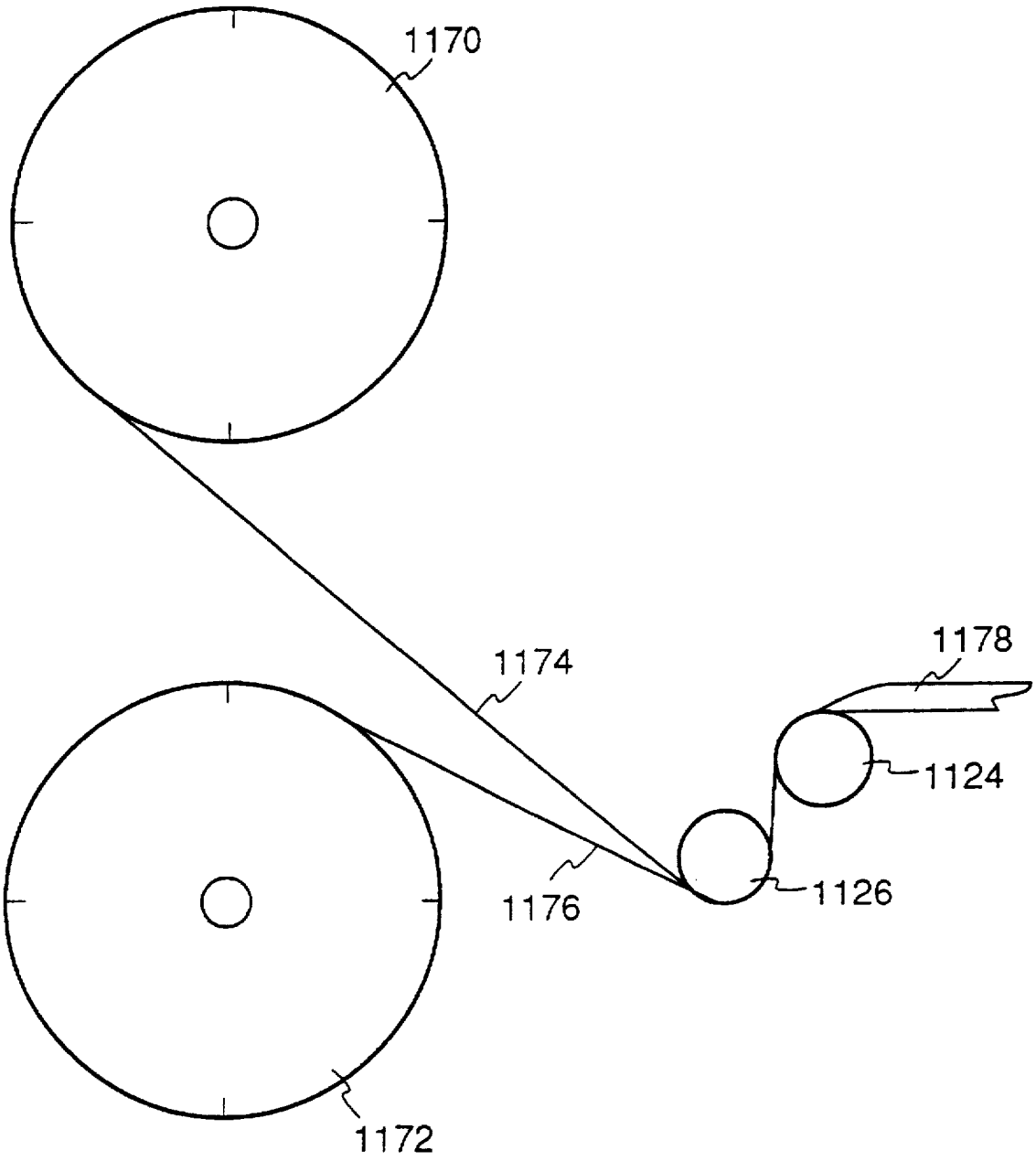
FIG. 12 is a schematic illustration of a two roll delivery system.

In another embodiment, the amount of paper which is delivered for expansion can be increased by using multiple layers of paper. The only change in the system is the use of a plurality of feed rolls to supply slit paper to the system. Alternatively, the sheet material 1112 can be in the form of multilayers of the slit expanded sheet material on a single roll. Thus, the requirement for the simultaneous feeding of multilayers can be achieved through the use of a multi-ply, single roll or a plurality of feed rolls. Each method has its advantages. The multi-roll allows the choice of using single ply rather than multi-ply. The use of multiple rolls does, however, take more space than the multi-ply, single roll system. As shown in FIG. 12, a first roll 1170 can be positioned above a second roll 1172. Paper is feed simultaneously between two guides rolls, 1124 and 1126 which serve as a tensioning mechanism, as previously described. The output 1178 is two layers of expanded sheet material.

When the filling material is wrapped around an article, it is in the form of a plurality of layers of interlocked expanded sheets due to the land areas of adjacent sheets of the layers of sheets nesting and interlocking with each other. Contraction of the expanded sheets is thus prevented or at least restricted.

The length of the slit and the ratio of the land intervals between slit affects the dimensions of the polygons which are formed during the expansion step. The higher the ratio of slit length to interval length the greater is the maximum angle which can be formed between the plane of the sheet and the planes of the land areas. The greater the uniformity of the shape and size of the formed polygonal shaped open areas and the angle to which the land areas incline relative to the flat sheet, the greater is the degree to which interlocking of land areas can be achieved. Interlocking of land areas, that is, the nesting of layers of sheets, reduces the effective thickness of the sheets. However, the net effect is still a dramatic increase in effective sheet thickness. For example, 0.008 inch thick paper having a slit pattern of a ½" slit, 3/16" slit spacing, and ⅛" row spacing, produces a ¼" by 3/16" land which can expand to under about one quarter of an inch thickness and will have a net effective thickness for two layers, when nested, of about 0.375 inches. It is noted that the land width is double the width of the legs. The net effect is a useful thickness expansion of roughly at least 20 times the unexpanded thickness of the paper.

The nesting of adjacent layers can occur to an excessive extent, as for example, where absolute uniformity of expansion exists in adjacent layers, and the adjacent layers merge or commingle with each other to a second layer adds to the combined thickness of two sheets only to the extent of the unexpanded thickness of the second sheet rather than the expanded thickness of the second sheet. Stated another way, where merging takes place rather than limited nesting, the cumulative effect of the addition of successive layers of sheets is based on a thickness increase relative to the unexpanded thickness of each successive sheet. The desired net effect is a nesting where the land of one layer drops into the cell of the adjacent layer only to the extent necessary to provide interlocking, that is, preclude relative motion of the layers. The overall object is to prevent slippage between adjacent layers, while maximizing the cumulative thickness of the layered material. Thus, on the one hand, the adjacent layers should interlock while on the other hand the adjacent layers should not interlock in order to maximize the thickness of the expanded, multilayered product.

The balance between interlocking and maximizing thickness can be achieved by offsetting the adjacent layers or offsetting the slit pattern and reversing the direction of offset on layer relative to the adjacent layer. The offsetting of the slit pattern can be relative to a multi-ply, single roll, in which adjacent plies are offset, as well as to a multi-ply configuration formed from two rolls of single ply material, as described above.

The parallel rows of individual slits preferably form an angle with the longitudinal axis (the opposing edges of the sheet) in the range from about 89.5 to 87 degrees. This produces the aforementioned offset. By alternating the adjacent rows the net offset between the parallel rows of slits of adjacent layers forms an angle in the range from about 1° to about 6°. That is, the line of slits of adjacent plies cross each other at an angle in the range from about 1° to about 6°. As shown in FIG. 12, two feed rolls 1170 and 1172 can be provided. By having one roll unwind counterclockwise and the other clockwise, the aforenoted crossing of the lines of slits of adjacent rolls occurs, producing the desired blend between interlocking and maximizing of expanded thickness.

The use of guide rolls to regulate the tensioning of the delivery system, is shown in FIGS. 13A through 13F. In FIG. 13A, no tension is provided on the sheet 1180, passing-between the guide rolls 1182 and 1184. The rotation of the two guide rolls relative to each other, as shown in FIG. 13B, produces moderate tension which is increased with the rotation of the relative roll positions as shown in FIGS. 13C and 13D. As the path of the paper becomes more tortuous, as illustrated in FIG. 13E and F, the tension increases.

The expansion drive rollers can be adjusted to alter the space between the rollers. In this manner, a required balance can be attained between compression of the paper sheet between the rollers and minimization of the crushing of the cells of the expanded paper. Once the process has been started and the paper is expanded, the Velcro hooks can grab and pull the expanded cells with little need to apply a compression force. Prior to the expansion, that is, during the start up, the pressure on the paper must be maximized since the inclined surfaces of the expanded paper are not yet available. A variety of mechanism are available to adjust for the change in the thickness of the paper and the creation of inclined surfaces.

In the embodiment of FIG. 14, the dual expansion rollers 1502 and 1504 are illustrated. The dual expansion rollers 1502 and 1504 are provided with a pair of rigid gripping wheels 1506, 1510 and 1508, 1512, respectively. The rigid wheels 1506, 1510, 1508 and 1512 are somewhat greater in diameter than the expansion rollers 1502 and 1504 and serve to grip the paper and draw it through. In the case of paper which expands to a thickness of one quarter of an inch, the difference between the diameter of rollers 1502 and 1504 and the wheels 1506, 1510 and 1508, 1512 must be greater than one quarter inch in order to avoid crushing the expanded paper. The use of small rigid wheels 1506, 1510 and 1508, 1512 to carry the paper limits the amount of expanded material which is contacted and therefore crushed. The wheels 1506, 1510, 1508 and 1512 can be formed of rubber or any of the materials disclosed for use with the expander rolls. The width of the wheels 1506, 1510 and 1508, 1512 is as small as feasible to limit the amount of expanded paper which is crushed. The wheels 1506, 1510 and 1508, 1512 leave an elongated path or region of crushed cells along the length of the paper.. Preferably, the wheels are about one half inch wide. Wider wheels provide greater gripping power but crush a greater amount of expanded cells. The amount of material crushed is equal to the width of the wheels times the number of wheels. The number of wheels is not narrowly critical but, the use of too few wheels will produce uneven drawing of the sheet material. At least two wheels are required, but three wheels evenly spaced along the draw rollers produced more consistent and even drawing of the paper. Since the wheels must be in opposed pairs, too narrow a width produces a risk that the opposed wheels will be out of alignment and fail to provide a gripping force. The minimum width of the wheels is controlled by the ability to keep the wheels in proper gripping alignment. The maximum width of the wheels is limited by need to minimized crushing of the expanded material. In the instance of a 20 inch wide paper, the use of four half inch wheels, crushes 10 percent of the paper. The combined width of the rollers multiplied by the number of rollers, must be less than 20% of the width of the expanded paper, and preferably should be less than 10% of the expanded width. Most preferably, the combined width is no more than 5% of the expanded paper width.

Figure 15:
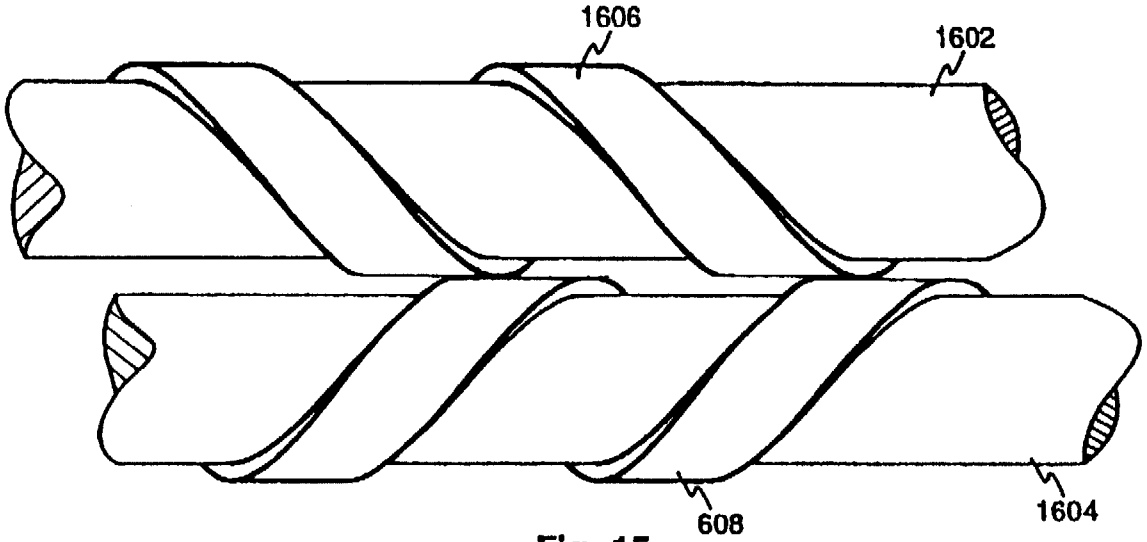
FIG. 15 is a fragmented illustration of an alternate two roll delivery system using filament wrap.
Figure 16:
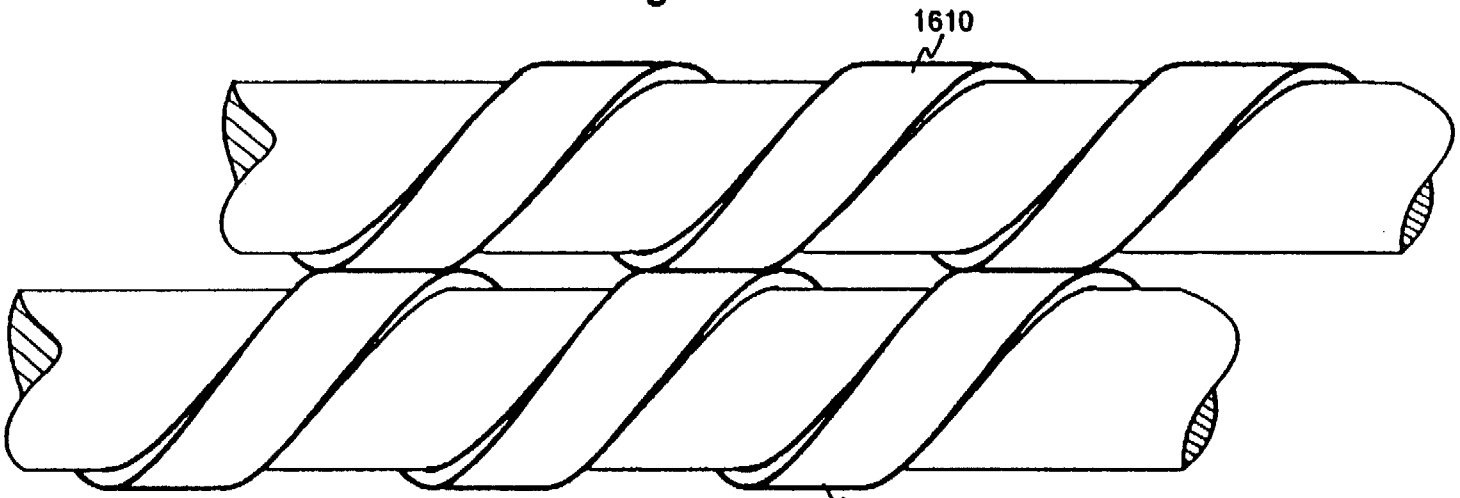
FIG. 16 is an alternate embodiment of FIG. 16.

In the embodiment of FIGS. 15 and 16, the Velcro® type hook filament material 1606, 1608 and 1610, 1612, respectively, is spirally wound around the draw rollers 1602 and 1604, illustrating two of the possible patterns. Once expanded the hook filaments 1606 and 1608 have a great drawing power and is not necessary to have the entire roll covered. In fact, using less than full coverage can be advantageous. Where the hook filament material 1606 an 1608 is spirally wound around each draw roll, contact with the expanded material is continuous, but the expanded sheet material is compressed between opposed hook material intermittently and only over a limited region. In this manner the paper is compressed during the start up of the expansion cycle, and once expanded the paper is drawn primarily on one surface unopposed by material. Thus, crushing of expanded paper is minimized.

In the embodiment of FIG. 15, the spiral of the hook filament material 1606 on the first roller 1602 is opposite from the spiral direction of the filament material 1608 on the second roller 1604. In this manner the hook filament material of the first draw roller 1602 is always opposed by the corresponding material of the second draw roller 1604. Preferably, as shown in FIG. 16, the filament material spirals 1610 and 1612 are in the same direction. In this manner, the two spirals 1610 and 1612 are only in opposition, or contact, periodically. In this manner, the paper is compressed between opposing spirals, as required to start the expansion process. Once expanded contact between the spirals 1610 and 1612 and the expanded paper is predominantly one side unopposed, thereby minimizing the problem of crushing of the expanded cells, while providing periodic high compression needed for the startup of the expansion cycle.

If preferred, the draw rollers can be provided with a solenoid or a pair of solenoids, one at each end. The solenoid is provided with a timer which raises the top roller slightly once the expansion is achieved, so that maximum start up compression is available to initiate the expansion, but minimal compression occurs after the expansion has been achieved so as to avoid crushing of the expanded cells. This is possible, because of the interaction between the hooks and the inclines of the expanded material. The hooks grab the paper and it is not necessary to force the paper against the hooks by means of an opposing roller. Light contact between the hooks and the expanded material is sufficient to draw the sheet of expanded paper and maintain the expansion operation. Once the rotation of the rollers has ceased, the solenoid releases the top roller to come in contact with the bottom roller.

Figure 18:
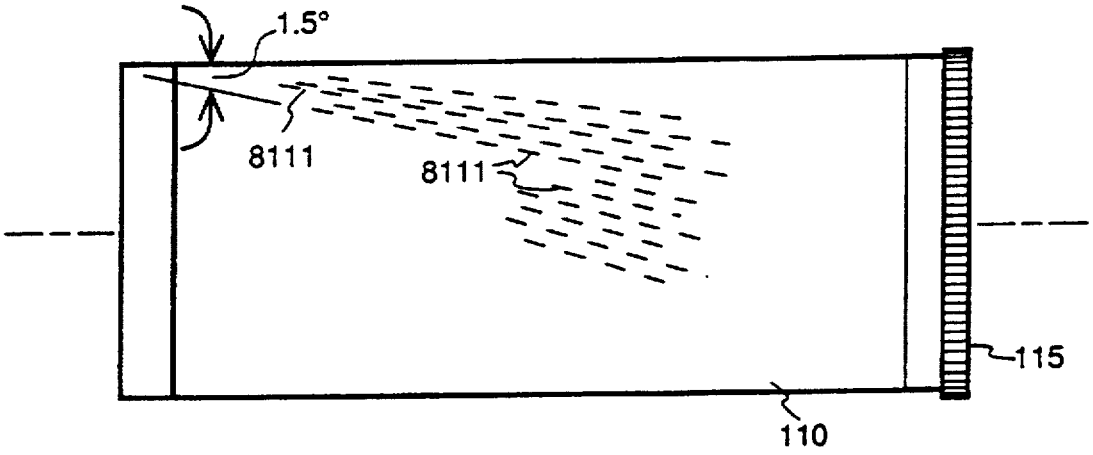
FIG. 18 is a top view of the knives of FIG. 17.

The rotary die cutting of the expanded paper is preferably performed using a hardened steel die with tolerances of 0.001 of an inch. The anvil is a round, extremely hard cylinder. It has been found that the cutting of the plurality of slits results in a vibration of the rotary die cutter and a shortening of the life of the equipment, in particular, the die. The vibration problem can, however, be eliminated by offsetting the knives about 1.5° from the axis of the die. It appears that the vibration is due to the fact that the rows of knives are spaced ⅛ inch apart. Even though the cutting action is on a sheet of paper only 0.007 or 0.008 inch thick, the net effect is a chopping action and a resultant vibration. The skewing of the knives results in a continuous cutting action, since there is a simultaneous entry of a plurality of knives into the paper and withdrawing from the paper. The range is limited at one extreme by the necessity for the slits to be close to being perpendicular to the edges of the web, so that during the expansion step, the expansion proceeds in a controlled manner. That is, the paper expanded without skewing in one direction. At the other extreme, the skewing of the knives must be sufficient to provide a continuous cutting and prevent die vibration. Accordingly., the skewing of the knives, as illustrated in FIG. 18, must be at least about 0.5 but less than 5 degrees. Optimally, the range is within 1.0 degrees and 1.75 degrees. When the paper is fed from two rolls to an expander, by reversing the angular offset of the rolls, the line of the cells formed from the slits, are offset by an angle which is double the offset produced by the skewing of the knives, rather than being parallel. This serves to optimize the nesting effect and maximize the cushioning effect.

The extendible sheet material can be a single layer of flexible paper material or multiple layers wound on the same roll. Preferably, the multiplies plies are formed in-situ by using multiple rolls of single layer sheet material which are combined in the guide roll path. The advantage of using, for example, two rolls of single layer sheet material is that where a small amount of material is required to wrap an object, a single roll can be used in the system. In applications where large amounts of void fill are required, two rolls can be unwound simultaneously, to produce a two-ply void fill material.

Where a plurality of plies of sheet material are used, either through the preferred use of two rolls or by using a multi-ply roll, the parallel rows of individual slits preferably form an angle with the longitudinal axis (the opposing edges of the sheet) in the range from about 89.5 to 87 degrees. Consequently, the parallel rows of slits of adjacent layers form an angle in the range from about 1° to about 6° with each other. That is, the line of slits of adjacent plies cross each other at an angle in the range from about 1° to about 6°.

Thus, the skewing of the knives not only improves the cutting operation but also optimizes the cushioning affect.

Figure 17:
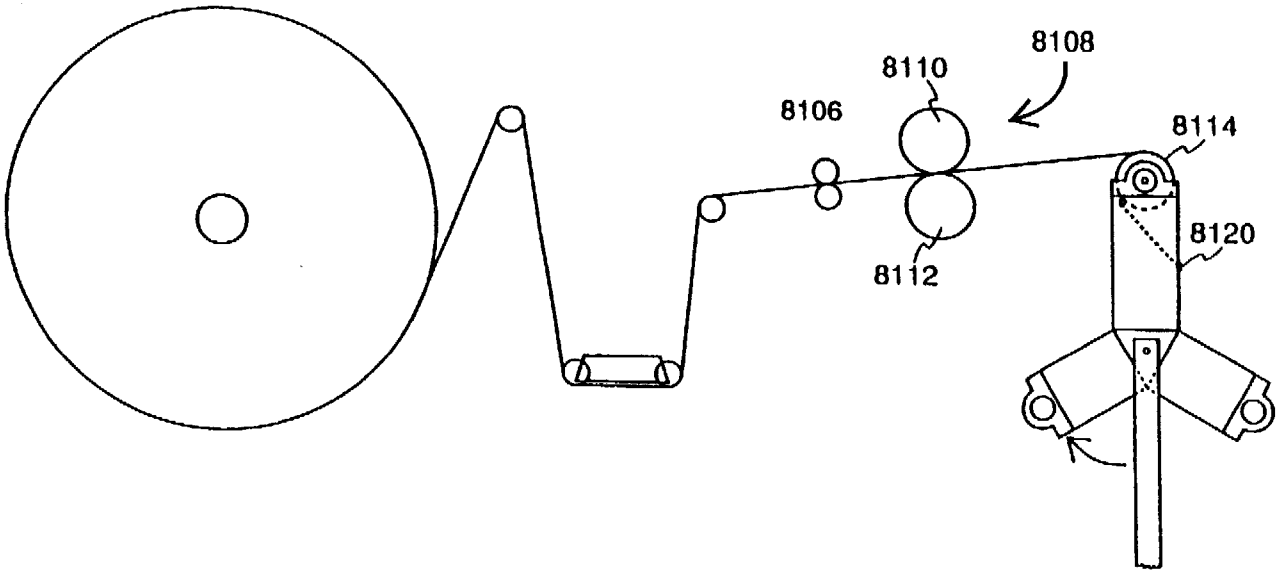
FIG. 17 is a schematic illustration of a slitting system.

The rotary die cutting equipment includes a paper supply roll and web tension guide. The web guide controls tracking of paper from side to side, thereby facilitating high speed die cutting. The roller serves to decurl the rolled paper, prior to die cutting. As shown in FIG. 17, the paper 8104 is fed between between nip rollers, to the die-cutting station indicated generally as 8108. The rotary die 8110, containing the knives 8111, shown in FIG. 18, interacts with the hard anvil 8112 to produced the desired slit pattern. The rotary die is driven by a conventional power source, not shown, and can be belt driven or driven through gear teeth. The slit paper is then wound on a rewind roller 8114. Nip rollers can be used between the rotary die cutting and the rewind roller 8114.

The web tension must be less than 4.5 oz. per inch of width. For paper webs less than 20 inches in width, the problem of maintaining the rewind tension within the necessary limits is particularly severe. This problem is discussed in copending patent application, Ser. No. 119,472, filed Sep. 10, 1993. The regulation of the rewind tension can be achieved through the use of a variable tension sensor and control 8120. The variable tension sensor and control senses the amount of paper which has been rewound on the rewind roller 8114. Preferably, the speed of the paper web through the rotary die 8110 is essentially constant. As the amount of paper on the rewind roller 8114 increases along with the diameter of the rewound web, the linear speed of the web increases. To maintain a constant tension., the rotational speed of the rewind roller 8114 must be decreased.

A highly sensitive plasma magnetic clutch or a hydraulic clutch can be used to maintain the rewind tension within the required limits, relative to the width of the paper web. When the rewind tension exceeds the proper limit, the cells open, and the paper is wound in the form of open cells. If the rewind tension is too low, the paper web is traveling at an uneconomically slow rate. Further, at low tension the roll is not tight. A tightly wound roll provides the optimum amount of material relative to the diameter of the roll. An open cell roll represents one extreme, while a tightly wound roll represents the other extreme. A loosely wound unexpanded roll is preferable to a tightly wound expanded roll. In order to amortize the cost of the equipment over a reasonable period of time, the paper through put must be maintained at the maximum possible speed. When the tension is unnecessarily low, the rewind mechanism becomes the bottle neck in the manufacturing operation.

The use of a rewind turret mechanism such as disclosed in British patent 777,576 Published Jun. 26, 1957, U.S. Pat. No. 1,739,381 and 2,149,832, provides for a continuous operation, in that the system need not be stopped when the rewind roll has the desired footage of material, preferably about 30 pounds of paper per roll.

Figure 19:
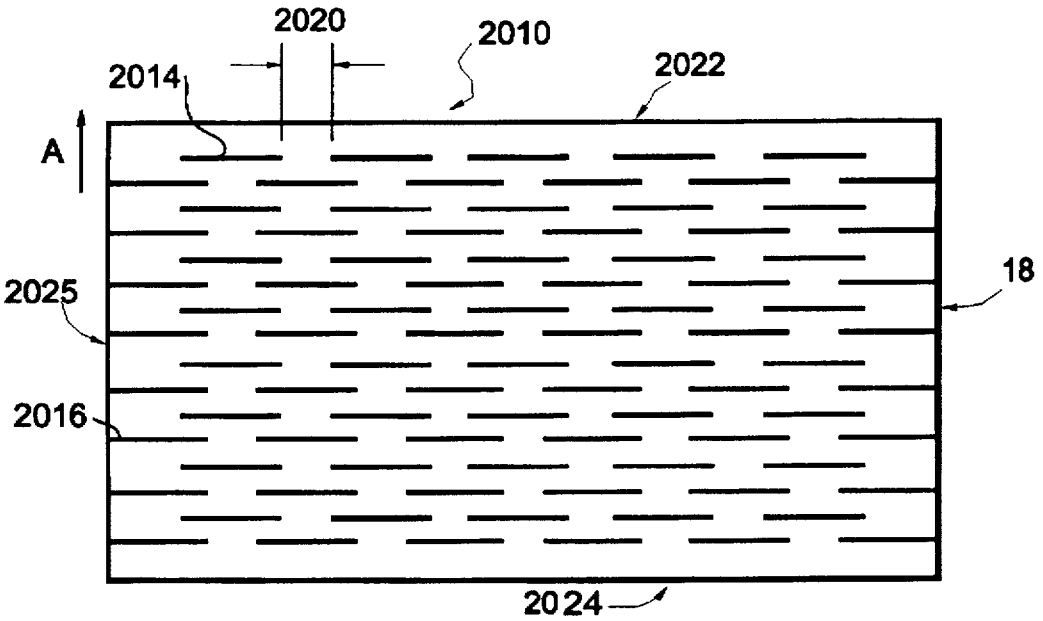
FIG. 19 is a plan view of a slit sheet.

The slit paper, indicated generally as 2010, is illustrated in FIG. 19 as it would come off the slitting machine. The sheets can be formed on a flat bed slitter and produced directly as rectangular sheets, as well as on a rotary slitter and cut into individual sheets or stored directly as a continuous sheet in roll form.

The flexible sheet 2010 is provided with slits 2014 and slits 2016 are parallel to the edges 2022 and 2024 of the flexible sheet 2012 and perpendicular to the paper grain. The slits 2014 and slits 2016 are placed in rows and separated from one another by land 2020 and legs 2021. The land 2020 is a consistent size and provides the support required to prevent the paper from tearing into strips when opened. The cushioning effect is produced by the flexing of the lands and legs under a load. It is therefor necessary that the land 2020 be of sufficient size to provide cushioning. The spacing between the rows of slits 2014 and slits 2016 must also be of sufficient size to prevent the paper from tearing. The off set positioning of the rows of slits 2014 and slits 2016 gives the paper resiliency when opened and is discussed in detail further hereinafter. The existence of partial slits 2014 and 2016 at the ends 2025 and 2018 of the flexible sheet 2010 do not hinder the efficiency of the slit paper 2010. The flexible sheet 2010 when flat, lies in a first plane.

Figure 20:
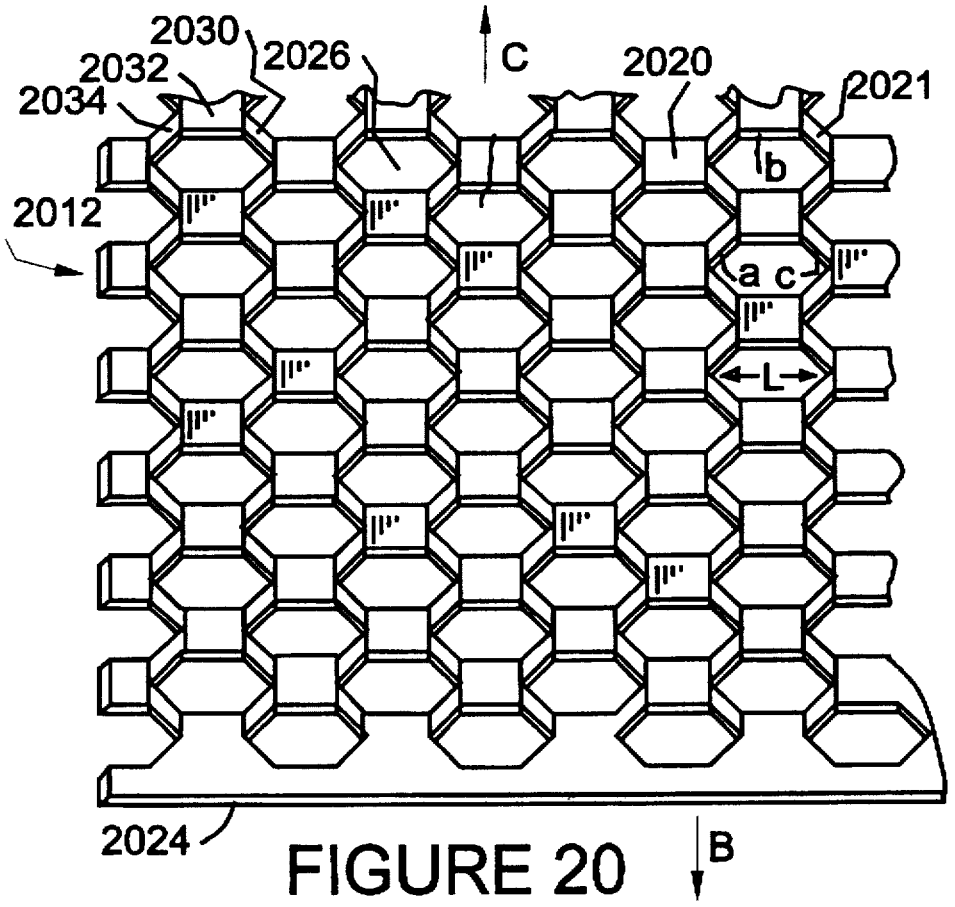
FIG. 20 is a plan view of the sheet of FIG. 20 in expanded form.

When expanded, the expanded sheet, indicated generally as 2012, is formed of hexagonal cells 2026, legs 2021 and land 2020 areas, as illustrated in FIG. 20. Preferably, at least a majority of the land 2020 areas lie in a plurality of parallel planes. The planes of the land 2020 areas form an angle of at least about 45 degrees with the plane of the sheet in flat form. The slit sheet 2012 is expandable by simply pulling the parallel edges 2022 and 2024 in the direction indicated by the arrows B and C. The expansion of the slit sheet 2010 opens the rows of slits 2014 and 2016 to form an array of hexagon cells 2026. As the slit sheet is expanded, the lands 2020 and legs 2021, are raised to form the sections 2030, 2032 and 2034 forming the two similar sides of each hexagonal cell 2026. The rotation upwardly and horizontally forms the raised padding effect. The quantity of land 2020 between the slits 2014 and 2016 and the distanced between the rows of slits 2014 and 2016 determine angle of the raised sections 2030, 2032 and 2034 and the degree of expansion. The greater the inclination angle, the greater the support.

Test Results

Figure 21:
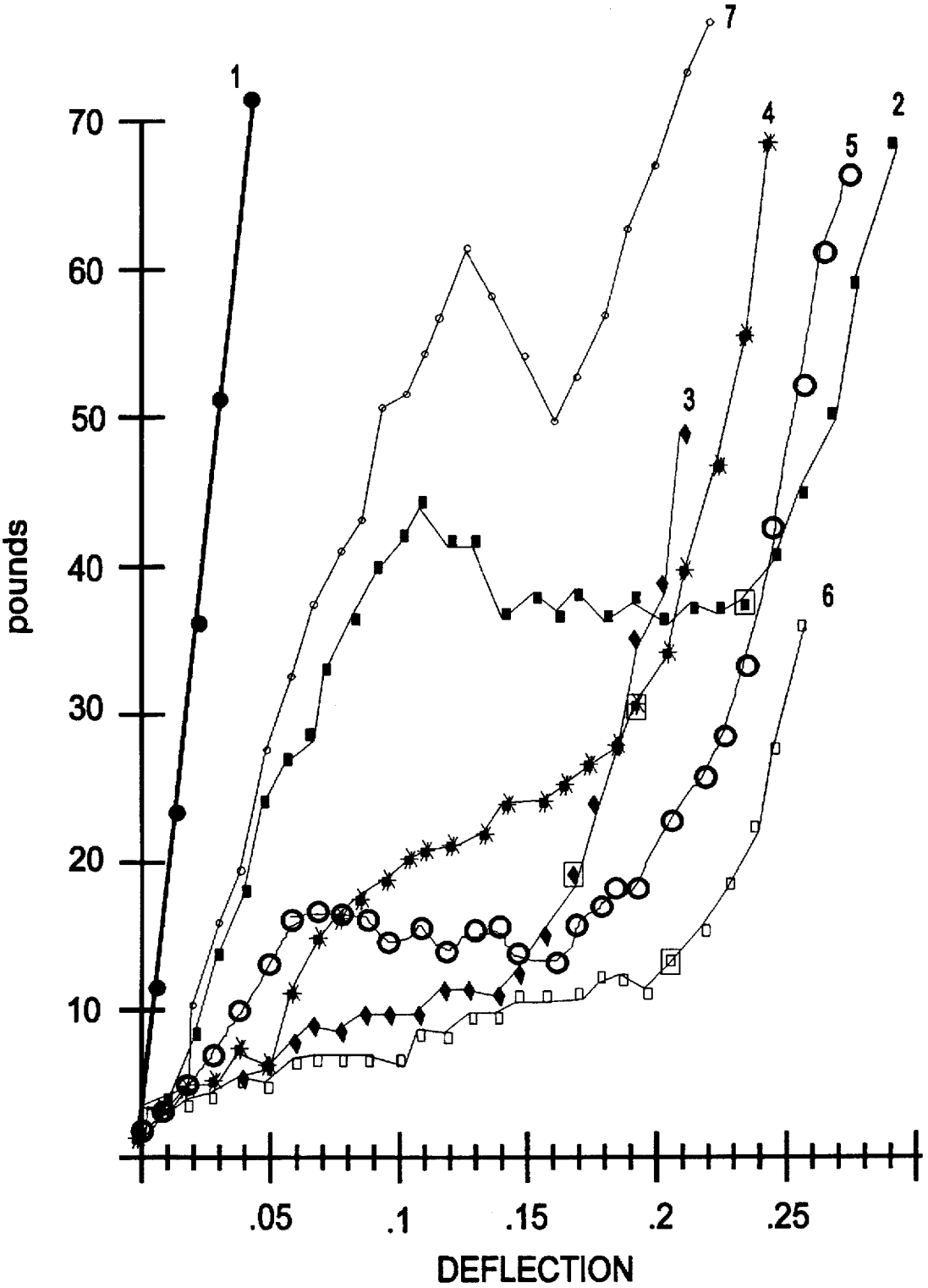
FIG. 21 is a graph showing compression tests of expanded sheets having different paper weight and differing slit patterns.

The compression testing of slit paper having varying slit patterns is shown in FIG. 21. Test 1, is the standardization for the test device. The test device test arm deflecture is Test 1, represents a control test of the arm deflecture;

Test 2, represents a 0.5/0.187/0.125 slit pattern;

Test 3, represents a 0.5/0.187/0.125 slit pattern;

Test 4, represents a 0.5/0.25/0.125 slit pattern;

Test 5, represents a 0.625/0.5625/0.125 slit pattern;

Test 6, represents a 1/0.375/0.125 slit pattern; and

Test 7, represents a 0.45/0.187/0.125 slit pattern.

The paper was a recycled 70 pound Kraft paper, (70 pounds per 3000 square feet, in accordance with Tappi 410 om-88), except for Test 3, which employed a 30 pound paper. The paper weight is in accordance with Tappi Standard T 410 om-88, for news, wrapping, tissue, paperboard and bag paper, Table 2, and is in pounds per 3000 square feet.

The tests were conducted on a prototype test device built by Cradco Company, of Madison, Va. The device employs load cells which do not compress under load and therefore provide readings of load vs. compression. Readings on the LCD scale are in pounds and the device uses a turn screw for compression of the material. A cylindrical scale is provide which provide readings in hundredths of an inch. The test material was compressed between a rigid steel member having a surface of 5 by 3 5/16 inches and a steel base-plate, having a larger surface than the steel member, over a wooden platform. Accordingly, the effective area under compression was 16.55/144 square inches or 0.11 square feet. The compression screw was rotated to produce compression in one hundreths increments. Readings were taken initially and then after the material under compression adjusted and a load decrease was noted. The support arm of the compression screw was capable of flexing and giving false end readings after the paper was fully compressed. The readings of test 1 are readings of arm flexure.

Test 3 differs from Test 2 only in paper weight, and shows that the paper weight corresponds to load bearing capacity, as evidenced by the difference in the slopes of the two lines. However, the relative contribution of the hexagonal cells is unaffected. This point is further evidenced by Test 5, which employed a slit pattern which did not yield hexagonal cells, but rather, which formed diamond cells. The load performance of the 30 pound hexagonal material was superior to that of the 70 pound hexagonal material in that far more usable cushioning is available from the 30 pound hexagonal cell material. The 70 pound diamond lost its cushioning capability at about one half of the deflection available with the 30 pound hexagonal cell material. Thus, the performance characteristic of the hexagon is essentially consistent over the range of paper weights which produce hexagonal cells, with the load bearing capacity being directly related to paper weight.

Tests 2, 3, 4, 6 and 7, show that the benefits of improved performance is not related to one particular cell ratio, but rather, is directly related to the formation of hexagonal cells. The pattern of Test 6 produced the same cell ratio as Tests 2 and 3, however, the larger size of the cell produced a relatively lower load bearing capacity. The pattern of Test 7 produced smaller cells than those produced by Tests 2 and 3, thus producing hexagons and a relatively higher load bearing capacity. The wrapping characteristics of the small cells, however, was poorer than that of the larger cells in that they did not open well around corners. The tendency of the cells to flatten around a bend resulted in a loss of cushioning in these regions. The pattern of Test 2 did not consistently produce hexagonal cells, in part due to the variations in the pattern having been hand cut. The pattern of Test 5 did not produce hexagonal cells. Variations in actual cell dimensions were sufficient to yield inconsistent results. Further, the dimensions were at the borderline of producing hexagonal cells.

TABLE 2

| | Ratio of the slit to slit spacing | | |
|---|---|---|---|
| Test | slit length | slit spacing | row spacing |
| 2 | 2.7 | 1 | .125 inch |
| 3 | 2.7 | 1 | " |
| 4 | 2 | 1 | " |
| 5 | 1.1 | 1 | " |
| 6 | 2.7 | 1 | " |
| 7 | 2.4 | 1 | " |

The use of the roughly 1:1 ratio did not yield hexagonal cells. The use of the roughly 3:1 ratio of Test 3 yielded large cells thereby providing greater length expansion than in Tests 2 and 3. This is due to the use of a larger slit length (about 1 inch long) and a lower density of material per square inch. The performance characteristics of Test 4 reflect variations in actual slit lengths from the desired theoretical length.

A ratio of slit length to slit spacing in the range from about 3:1 to 2:1 produces the desired results with a ratio in the range from about 2.5:1 to 3:1 being preferred. The selection of the slit length is in part related to the desired end use, with a length of about one half inch, (about 12 cm.) to about ¾ inch (about 20 cm.) being preferred and about one half inch (13 cm) being most preferred. A ratio slit length to slit spacing of about 2.7 to 1, is intended to encompass the range from 3:1 to 2.5 to 1. As the ratio increases, the length of the legs "a" and "c" increase, until the ability to form a hexagon is lost. The higher the ratio, the greater the incline and conversely, the lower the lower the ratio the lower the incline. The lower the incline the lower the thickening and since a thickening of at least ten to one and preferably, twenty to one is preferred, a low ratio is not desirable. Thus, too high a ratio causes a loss of the hexagonal cell and too low a ratio produces insufficient thickening upon expansion. A slit length of roughly one half inch and a slit spacing of about one fourth to about one third the slit length produces optimum results. Preferably the slit length is under three quarters of an inch (20 cm.).

The cell side "b", of FIG. 20, is determined by the slit spacing and each of the legs "a" and "c" are equal to one half of the difference between the slit length and the slit spacing. Spacing of the slit rows relate to the thickness of the legs but not to the cell dimensions. The width of the lands are thus equal to twice the slit row space and the width of the legs is equal to the slit row spacing.

The spacing between the rows of slits is directly related to the amount which the sheet material expands in thickness upon stretching. The greater the spacing of the rows the greater the thickness of the expanded sheet and the stiffer the legs of the hexagon. The extent of thickening is also related to the degree to which the land rotates. Thus, in the case of a 60° incline, a 0.125 row spacing yields a 0.217 expanded thickness. (The thickening is based on double the row spacing times the sine of the in-line angle, that is, 0.866×2×0.125.)

FIG. 21, shows that improved results are obtained with hexagonal cells, as compared to non-hexagonal cells, with differing hexagonal sizes producing varying improvement, as explained above.

It is to be understood that the filling material sheets of the present invention may be formed of any desirable and suitable dimensions depending upon the hollow spaces to be filled in packaging materials. While the description of the filling material sheet member of the present invention describes one example with respect to size and thickness, this is not intended to limit the scope of the invention. Where the slit pattern and paper characteristics have interacted to form a hexagonal cell, the slit paper has sufficient resistance to expansion, to permit the sheet material in roll form, to be rewound without expansion. This is not the case for slit pattern/material characteristic combinations which fail to produce the hexagonal pattern. Where the legs of the cells are insufficiently rigid to form the hexagonal shape, the cells are also excessively easy to open. In such cases, the sheets have to have the slit patterns cut on a flat press, for the sheets to be shipped unexpanded, since the conventional rewind rolling action would expand the slit sheets.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. An apparatus for forming a cushioning material for use as a packaging material comprising:

a source of flexible material in its unexpanded form, said material having:

a plurality of spaced parallel rows of individual slits extending transversely from one end of the sheet material to the opposing end of said sheet material, each of said rows having interval spaces between consecutive slits;

said slits in each row being positioned adjacent the interval space between consecutive slits in the adjacent parallel row of slits;

a first pair of drive rolls, a second pair of expander rolls, said flexible material extending from said source to said pair of driver rolls, said material passing between said drive rolls to said expander rolls, at least one of said expander rolls having slit material gripping means on its surface, whereby rotation of said driver rolls draws material from its source and rotation of said expander rolls at a rotational speed greater than the rotational speed of said driver rolls expands the material, said gripping means on said expander rolls having projections greater in length than the expanded thickness of said material in its expanded form, thereby engaging said material without crushing the expanded material, said sheet being expanded by extending the opposing ends of each sheet between said drive rolls and said expander rolls, parallel to the rows of slits whereby the slits form an array of openings, each opening being generally similar in shape and size, said sheet in substantially expanded form having a sufficient load bearing capacity and sufficient elastic potential energy to protect an article in transit against impact damage, by cushioning the article.

2. The apparatus of claim 1, further comprising spiral winding means, said spiral winding means being positioned to receive said expanded material and wind said expanded material into a spiral, whereby a cushioning cylinder is formed from a spiral of said flexible, sheet material.

3. The apparatus of claim 1, wherein said slit material gripping means is a plurality of moderately firm bristles uniformly distributed along the surface of at least one expander roll.

4. An apparatus for forming a cushioning material for use as a packaging material comprising:

a source of flexible material in its unexpanded form, said material having:

a plurality of spaced parallel rows of individual slits extending transversely from one end ox the sheet material to the opposing end of said sheet material, each of said rows having interval spaces between consecutive slits;

said slits in each row being positioned adjacent the interval space between consecutive slits in the adjacent parallel row of slits;

a first pair of drive rolls, a second pair of expander rolls, said flexible material extending from said source to said pair of driver rolls, said material passing between said drive rolls to said expander rolls, at least one of said expander rolls having slit material gripping means on its surface, whereby rotation of said driver rolls draws material from its source and rotation of said expander rolls at a rotational speed greater than the rotational speed of said driver rolls expands the material, said gripping means on said expander rolls engaging said material without crushing the expanded material, said sheet being expanded by extending the opposing ends of each sheet between said drive rolls and said expander rolls, parallel to the rows of slits whereby the slits form an array of openings, each opening being generally similar in shape and size, said sheet in substantially expanded form having a sufficient load bearing capacity and sufficient elastic potential energy to protect an article in transit against impact damage, by cushioning the article, said slit material gripping means being a plurality of moderately firm bristles uniformly distributed along the surface of at least one expander roll.

5. The apparatus of claim 4, wherein said slit material gripping means is a plurality of moderately firm bristles uniformly distributed along the surface of at least one expander roll, said bristles having hook means on its outer end, the barb of said hook being oriented to engage the slits in said material during the rotation of said expander rolls.

6. The apparatus of claim 4, wherein said slit material gripping means is a plurality of moderately firm bristles uniformly distributed along the surface of at least one expander roll, said bristles having hook means on its outer end, the barb of said hook being oriented in the leading position whereby said barbs engage the slits in said material during the rotation of said expander rolls.

7. The apparatus of claim 4, wherein said expander rolls apply an expansion force of in the range from about 3 oz. to about 7 oz. per linear inch to said slit material.

8. The apparatus of claim 4, wherein said slit material gripping means is a plurality of moderately firm bristles uniformly distributed along the surface of a first expander roll in a spiral pattern, and a plurality of moderately firm bristles uniformly distributed along the surface of a second expander roll in a spiral pattern, the first and second expander rolls being spaced apart a distance such that said bristles of each roll engage openings in said slit material when expanded.

9. The apparatus of claim 4, where said bristles of said first expander roll opposes said bristles of said second expander roll during a portion of the rotation cycle, thereby grabbing said unexpanded paper and are unopposed during the remainder of said rotation cycle, thereby engaging expanded slit sheet material without crushing.

10. The apparatus of claim 4, wherein at least one of said expander rolls having slit material gripping means on its surface, said slit material gripping means being a plurality of narrow gripping wheels mounted to a first expander roll, said gripping wheels engaging said sheet material and gripping said sheet material against a second expander roll.

11. The apparatus of claim 10, wherein the space between said first and said second roller is at least about equal to the expanded thickness of said expanded sheet material.

12. The apparatus of claim 11, further comprising a plurality of gripping wheels on said second roller, said gripping wheels on said first roller being positioned to engage said gripping wheels on said second roller.

13. The apparatus of claim 12, wherein each roller is provided with at least three gripping wheels, and wherein the combined width of said gripping wheels on said first roller is no greater than about twenty per cent of the width of said expanded sheet material.

* * * * *